United States Patent [19]

Pai

[11] Patent Number: 4,760,005

[45] **Date of Patent: * Jul. 26, 1988**

[54] AMORPHOUS SILICON IMAGING MEMBERS WITH BARRIER LAYERS

[75] Inventor: Damodar M. Pai, Fairport, N.Y.

[73] Assignee: Xerox Corporation, Stamford, Conn.

[ * ] Notice: The portion of the term of this patent subsequent to May 19, 2004 has been disclaimed.

[21] Appl. No.: 925,947

[22] Filed: Nov. 3, 1986

[51] Int. Cl.[4] ..... G03G 5/086; G03G 5/14

[52] U.S. Cl. ..... 430/65; 430/57; 430/66; 430/67; 430/86

[58] Field of Search ..... 430/57, 65, 66, 67, 430/86

[56] References Cited

U.S. PATENT DOCUMENTS

| | | | |
|---|---|---|---|
| 4,418,132 | 11/1983 | Yamazaki | 430/67 X |
| 4,451,546 | 5/1984 | Kawamura et al. | 430/57 X |
| 4,460,669 | 7/1984 | Ogawa et al. | 430/57 |
| 4,460,670 | 7/1984 | Ogawa et al. | 430/57 |
| 4,483,911 | 11/1984 | Ogawa et al. | 430/65 |
| 4,501,807 | 2/1985 | Shirai et al. | 430/57 |
| 4,510,224 | 4/1985 | Yamazaki et al. | 430/57 |
| 4,518,670 | 5/1985 | Matsuzaki et al. | 430/58 |
| 4,522,905 | 6/1985 | Ogawa et al. | 430/60 |
| 4,666,803 | 5/1987 | Yamazaki | 430/57 |
| 4,666,806 | 5/1987 | Pai et al. | 430/66 X |

FOREIGN PATENT DOCUMENTS

| | | | |
|---|---|---|---|
| 3321135 | 12/1983 | Fed. Rep. of Germany | 430/66 |
| 59-119358 | 10/1984 | Japan | 430/65 |

*Primary Examiner*—Roland E. Martin
*Attorney, Agent, or Firm*—E. O. Palazzo

[57] ABSTRACT

An imaging member comprised of a supporting substrate, a barrier layer of hydrogenated amorphous silicon nitride with dopants, a hydrogenated amorphous silicon photoconducting layer, and in contact therewith a top overcoating layer of nonstoichiometric silicon nitride.

28 Claims, 1 Drawing Sheet

AMORPHOUS SILICON IMAGING MEMBERS WITH BARRIER LAYERS

BACKGROUND OF THE INVENTION

This invention is generally directed to amorphous silicon imaging members, and more specifically, the present invention is directed to photoresponsive layered imaging members, or devices comprised of hydrogenated amorphous silicon and barrier layers of hydrogenated amorphous silicon nitride containing dopants such as boron. In one embodiment of the present invention there is provided a layered photoresponsive imaging member comprised of a supporting substrate, a barrier layer of hydrogenated amorphous silicon nitride with dopants therein, a bulk photoconducting layer of hydrogenated amorphous silicon with dopants, and in contact therewith an overcoating layer of silicon nitride, preferably with an excess of silicon. Further, in a specific embodiment of the present invention there is provided a layered photoresponsive imaging member comprised of a supporting substrate, a barrier layer of hydrogenated amorphous silicon nitride with small amounts of boron therein, a bulk boron doped photoconducting layer of hydrogenated amorphous silicon, and in contact therewith an overcoating layer of silicon nitride with an excess of silicon. These imaging members can be incorporated into electrographic, and in particular xerographic imaging and printing systems, wherein the latent electrostatic images which are formed can be developed into images of high quality, and excellent resolution. Moreover, these members posses high charge acceptance values in excess of 50 volts per micron, and the members can be of a very desirable thickness of from, for example, about 60 microns or less. Also, the imaging members of the present invention exhibit desirable low dark decay properties when selected for xerographic imaging systems. In these systems, latent electrostatic images are formed on the devices involved, followed by developing the images with known developer compositions, subsequently transferring the images to a suitable substrate, and optionally permanently affixing the image thereto. In addition, the photoresponsive imaging members of the present invention when incorporated into xerographic imaging and printing systems are insensitive to humidity conditions and corona ions generated from corona charging devices enabling these members to generate acceptable images of high resolution for an extended number of imaging cycles exceeding, in most instances, more than 100,000 imaging cycles, and approaching over 500,000 imaging cycles. Also, the specific imaging members of the present invention eliminates the high undesirable lateral movement of charges at the interface between the photoconducting layer, and the silicon nitride overcoating reducing band bending thus enabling images with increased resolution and less print deletions. Furthermore, the barrier layers of the present invention prevent broad area injection of minority carriers, and microinjection sites that cause image defect sites such as white spots. Further, the barrier layers of the present invention prevent the build up of residual potentials. Additionally, the barrier layers of the present invention act as an acceptable adhesive layer.

Electrostatographic imaging, and particularly xerographic imaging processes, are well known and are extensively described in the prior art. In these processes, generally a photoresponsive or photoconductor material is selected for forming the latent electrostatic image thereon. This photoreceptor is generally comprised of a conductive substrate containing on its surface a layer of photoconductive material, and in many instances a thin barrier layer is situated between the substrate and the photoconductive layer to prevent charge injection from the substrate, which injection would lower the charge acceptance and adversely effect the quality of the resulting image. Examples of known useful photoconductive materials include amorphous selenium, alloys of selenium such as selenium-tellurium, selenium-arsenic, and the like. Additionally, there can be selected as the photoresponsive imaging member various organic photoconductive materials including, for example, complexes of trinitrofluorenone and polyvinylcarbazole. Moreover, recently there has been disclosed multilayered organic photoresponsive devices comprised of an aryl amine hole transporting molecule dispersed in an inactive resinous binder and a photogenerating layer, reference U.S. Pat. No. 4,265,990, the disclosure of which is totally incorporated herein by reference. Examples of charge transport layers disclosed in this patent include various diamines, while examples of photogenerating layers include trigonal selenium, metal and metal-free phthalocyanines, vanadyl phthalocyanines, squaraine compositions, and other similar substances.

Additionally, amorphous silicon photoconductors are known, thus for example there is disclosed in U.S. Pat. No. 4,265,991 an electrophotographic photosensitive member with a thickness of 5 to 80 microns comprised of a substrate and photoconductive overlayer of amorphous silicon containing 10 to 40 atomic percent of hydrogen. Further, there are described in this patent several processes for preparing amorphous silicon. In one process embodiment, there is prepared an electrophotographic sensitive member by heating the member in a chamber to a temperature of from 50° C. to 350° C., introducing a silicon and hydrogen containing gas into the vacuum chamber causing an electrical discharge by electric energy to ionize the gas in the space of the chamber in which a silicon compound is present, followed by depositing amorphous silicon on an electrophotographic substrate at a rate of 0.5 to 100 Angstroms per second thereby resulting in a hydrogenated amorphous silicon photoconductive layer of a predetermined thickness. While the amorphous silicon device described in this patent is photosensitive, after a minimum number of imaging cycles, less than about 10,000 for example, unacceptable low quality images of poor resolution with many deletions result. With further cycling, that is subsequent to 10,000 imaging cycles, the image quality continues to deteriorate often until images are partially deleted. Accordingly, while the amorphous silicon photoresponsive device of the '991 patent is useful, its selection as a commercial device which can be used functionally for a number of imaging cycles is not readily achievable.

There are also disclosed in U.S. Pat. No. 4,634,647, the disclosure of which is totally incorporated herein by reference, imaging members comprised of compensated amorphous silicon compositions, wherein there are simultaneously present in the amorphous silicon dopant materials of boron and phosphorus. More specifically, there is disclosed in the copending application a photoresponsive device comprised of a supporting substrate, and an amorphous silicon composition containing from about 25 parts per million by weight to about 1 weight percent of boron compensated with from about 25 parts per million by weight to about 1 weight percent of phosphorus. These members may also contain a top overcoating layer of silicon nitride, silicon carbide or amorphous carbon with stoichiometric amounts of silicon and nitrogen, or silicon and carbon.

Moreover, disclosed in copending application Ser. No. 548,117, now U.S. Pat. No. 4,544,617, the disclosure of which is totally incorporated herein by reference, is an imaging member comprised of a supporting substrate, a photoconducting layer comprised of uncompensated or undoped amorphous silicon, or amorphous silicon slightly doped with p or n type dopants such as boron or phosphorus, a thin trapping layer comprised of amorphous silicon which is heavily doped with p or n type dopants such as boron or phosphorus, and a top overcoating layer of stoichiometric silicon nitride, silicon carbide, or amorphous carbon; and wherein the top overcoating layer can be optionally rendered partially conductive.

The use of specific barrier layers in amorphous silicon imaging members is disclosed, for example, in U.S. Pat. No. 4,359,512. More specifically, there are disclosed in this patent hydrogenated amorphous silicon imaging members with barrier layers of amorphous silicon doped with boron, or other similar substances.

Also, U.S. Pat. No. 4,394,426 discloses hydrogenated amorphous silicon members with barrier layers of undoped silicon nitride; U.S. Pat. Nos. 4,452,874 and 4,452,875 disclose hydrogenated amorphous silicon members with two layers between the photoconductive bulk layer and substrate. It is indicated in these patents that the first adhesive layer of undoped silicon nitride is followed by a barrier layer of amorphous silicon doped with boron. Further, these patents describe three layers situated between the bulk photoconductive layer and the substrate, that is an adhesive layer of undoped silicon nitride, a barrier layer of boron doped silicon, and an adhesive layer of undoped silicon nitride. Presumably the first adhesive layer improves adhesion between the substrate and the second barrier layer, and the third layer improves adhesion between the barrier layer and the bulk. Some disadvantages associated with the aforementioned members are: (1) although the high concentration boron doped barrier layer functions as a barrier against minority carrier injection, it does not possess adhesive characteristics, thus with such a barrier adhesive failure in amorphous silicon imaging members is frequently encountered; and (2) undoped silicon nitride is not an acceptable barrier when the nitride is nonstoichiometric and contains excess silicon. Near stoichiometric silicon nitride although an acceptable barrier against electron injection is highly resistive, and therefore develops a residual potential. Further, although the three layer $SiN_x$—SiB+—$SiN_x$ structure satisfies the adhesive as well as the barrier needs, the process for the preparation thereof involves changing gases several times to obtain the three layer structure.

Further, there is disclosed in the prior art amorphous silicon photoreceptor imaging members containing, for example, stoichiometric silicon nitride overcoatings; however, these members in some instances generate prints of low resolution as a result of the band bending phenomena. Additionally, with the aforementioned silicon nitride overcoatings, the resolution loss can in many instances be extreme thereby preventing, for example, any image formation whatsoever.

Additionally, described in U.S. Pat. No. 4,613,556, entitled Heterogeneous Electrophotographic Imaging Members of Amorphous Silicon, the disclosure of which is totally incorporated herein by reference, are imaging members comprised of hydrogenated amorphous silicon photogenerating compositions, and a charge transporting layer of plasma deposited silicon oxide.

Other representative prior art disclosing amorphous silicon imaging members, including those with overcoatings, are U.S. Pat. Nos. 4,460,669; 4,465,750; 4,394,426; 4,394,425; 4,409,308; 4,414,319; 4,443,529; 4,452,874; 4,452,875; 4,483,911; 4,359,512; 4,403,026; 4,416,962; 4,423,133; 4,460,670; 4,461,820; 4,484,809; and 4,490,453. Additionally, patents that may be of background interest with respect to amorphous silicon photoreceptor members include, for example, U.S. Pat. Nos. 4,359,512; 4,377,628; 4,420,546; 4,471,042; 4,477,549; 4,486,521; and 4,490,454.

Further, additional representative prior art patents that disclose amorphous silicon imaging members include, for example, U.S. Pat. No. 4,357,179 directed to methods for preparing imaging members containing high density amorphous silicon or germanium; U.S. Pat. No. 4,237,501 which discloses a method for preparing hydrogenated amorphous silicon wherein ammonia is introduced into a reaction chamber; U.S. Pat. Nos. 4,359,514; 4,404,076; 4,403,026; 4,397,933; 4,423,133; 4,461,819; 4,237,151; 4,356,246; 4,361,638; 4,365,013; 3,160,521; 3,160,522; 3,496,037; 4,394,426; and 3,892,650. Of specific interest are the amorphous silicon photoreceptors illustrated in U.S. Pat. Nos. 4,394,425; 4,394,426 and 4,409,308 wherein overcoatings such as silicon nitride and silicon carbide are selected. Examples of silicon nitride overcoatings include those with a nitrogen content of from about 43 to about 60 atomic percent.

Additionally, processes for depositing large area defect free films of amorphous silicon by the glow discharge of silane gases are described in Chittick et al., the *Journal of the Electrochemical Society,* Volume 116, Page 77, (1969). Further, the fabrication and optimization of substrate temperatures during amorphous silicon fabrication are illustrated by Walter Spear, the *Fifth International Conference on Amorphous and Liquid Semiconductors* presented at Garmisch Partenkirchen, West Germany in 1963. Other silicon fabrication processes are described in the *Journal of Noncrystalline Solids,* Volumes 8 to 10, Page 727, (1972), and the *Journal of Noncrystalline Solids,* Volume 13, Page 55, (1973).

While the above described imaging members, particularly those disclosed in the copending applications, are suitable for their intended purposes, there continues to be a need for improved imaging members comprised of amorphous silicon. Additionally, there is a need for amorphous silicon imaging members that possess desirable high charge acceptance and low charge loss in the dark. Furthermore, there continues to be a need for improved amorphous silicon imaging members with new barrier layers, and overcoating layers of nonstoichiometric silicon nitrides enabling the substantial elimination of the undesirable lateral motion of charge, and thereby allowing for the generation of images of increased resolution when compared to amorphous silicon imaging members with stoichiometric overcoatings of silicon nitride. Additionally, there continues to be a need for improved layered imaging members of amorphous silicon which are humidity insensitive, and are not adversely effected by electrical consequences resulting from scratching and abrasion. There is also a need for amorphous silicon imaging members which can be selected for use in repetitive imaging and printing systems. Furthermore, there is a need for amorphous silicon imaging members which have the property of low surface potential decay rates in the dark, and yet are photosensitive in the visible and near visible wavelength range. Further, there is a need for hydrogenated amorphous silicon imaging members with barrier layers that satisfy the adhesive as well as barrier requirements without having to formulate multilayer structures.

SUMMARY OF THE INVENTION

It is therefore an object of the present invention to provide photoresponsive imaging members with high charge acceptance and low dark decay characteristics.

In another object of the present invention there are provided layered imaging members comprised of amorphous silicon with new barrier layers, and overcoatings of nonstoichiometric silicon nitrides.

In a further object of the present invention there are provided layered photoconductive imaging members comprised of barrier layers of doped amorphous silicon nitride.

In yet another object of the present invention there are provided layered photoresponsive imaging members which are rendered photosensitive in the near infrared by suitable alloying of the amorphous silicon photogeneration layer with germanium and tin, or compositions based on carbon and germanium.

In another object of the present invention there are provided layered imaging members comprised of doped amorphous silicon photogenerating or bulk layers with overcoatings of nonstoichiometric silicon nitrides, and barrier layers of boron doped silicon nitride, thus substantially eliminating the lateral motion of charge at the interface of the photogenerating layer, and the overcoating thereby reducing blurring and providing images of increased resolution.

In still another object of the present invention there are provided layered imaging members comprised of doped amorphous silicon photoconducting or bulk layers with overcoatings of nonstoichiometric silicon nitrides, and barrier layers of boron doped silicon nitride, thus substantially improving the adhesion of the device to the substrate. Furthermore, in another object of the present invention there are provided layered imaging members comprised of doped amorphous silicon photoconducting or bulk layers with overcoatings of nonstoichiometric silicon nitrides and barrier layers of boron doped silicon nitride, thus eliminating the need for a five layered structure.

In a further object of the present invention there are provided imaging and printing processes with amorphous silicon imaging members with barrier layers of doped hydrogenated amorphous silicon nitride, and silicon nitride overcoating layers, thus substantially eliminating the lateral motion of charge at the interface of the photogenerating layer and the overcoatings, and thereby reducing blurring, and providing images of increased resolution.

These and other objects of the present invention are accomplished by the provision of a multilayered amorphous silicon photoresponsive imaging member with new barrier layers. More specifically, in accordance with the present invention there are provided layered photoresponsive imaging members comprised of a supporting substrate, a barrier layer of doped amorphous silicon nitride, a bulk photoconducting layer of hydrogenated amorphous silicon doped with small concentrations of boron, and a top overcoating layer of nonstoichiometric silicon nitride. In one specific embodiment of the present invention there is provided a photoresponsive imaging member comprised of a supporting substrate, a barrier layer of hydrogenated amorphous silicon nitride with excess silicon and about 100 parts per million of boron, a photoconducting layer of hydrogenated amorphous silicon with about 3 parts per million of boron, and a top protective overcoating layer of nonstoichiometric silicon nitride with an excess of silicon. The photoresponsive imaging members illustrated when incorporated into xerographic imaging systems possess high charge acceptances of 50 volts per micron or greater, possess very low dark decay characteristics; and these members can be fabricated with the desirable properties in thicknesses of 60 microns or less. Also, the imaging members of the present invention enable the generation of images with increased resolution in view of the elimination of the lateral movement of charge at the interface of the overcoating layer, the undesirable injection of minority carriers is eliminated; and further, adhesion between the substrate and the photoconductor is improved.

Therefore, the photoresponsive members of the present invention can be incorporated into various imaging systems, particularly xerographic imaging systems. In these systems, latent electrostatic images are formed on the members involved, followed by developing the images with known developer compositions, subsequently transferring the image to a suitable substrate, and optionally permanently affixing the image thereto. Moreover, the photoresponsive imaging members of the present invention can be selected for use in xerographic printing systems inclusive of those with solid state laser or electroluminescent light sources as these members can be rendered sufficiently sensitive to wavelengths of up to 7,800 Angstroms when the photogeneration layer is suitably alloyed with germanium or tin, or fabricated from germanium-carbon alloys. The photoresponsive imaging members of the present invention, when incorporated into these systems, are insensitive to humidity conditions and corona ions generated from corona charging devices enabling these members to generate acceptable images of high resolution for an extended number of imaging cycles exceeding, in most instances, 100,000 imaging cycles, and approaching over 500,000 thousand imaging cycles.

BRIEF DESCRIPTION OF THE DRAWINGS

For a better understanding of the present invention and further features thereof, reference is made to the following detailed description of the preferred embodiments wherein.

Figure 1:
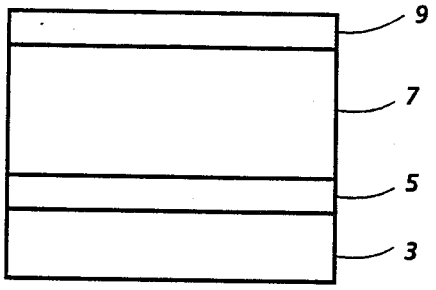
FIG. 1 is a partially schematic cross-sectional view of the photoresponsive imaging member of the present invention.

Illustrated in FIG. 1 is a photoresponsive imaging member of the present invention comprised of a supporting substrate 3; barrier layers 5 of a thickness of from about 0.02 to 1 micron of hydrogenated, from about 10 to about 40 atomic percent of hydrogen, amorphous silicon nitride with dopants; a photoconducting layer 7 with dopants of a thickness of from about 2 to 60 microns of hydrogenated, from about 10 to 40 atomic percent of hydrogen, amorphous silicon; and a transparent nonstoichiometric silicon nitride or silicon carbide top overcoating layer 9 of a thickness of from about 0.1 to 0.5 micron.

Figure 2:
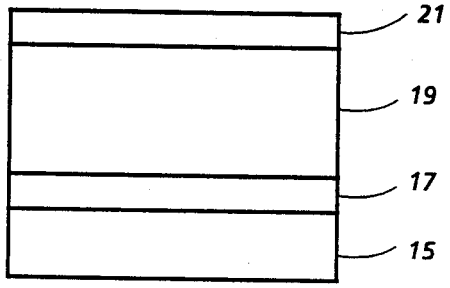
FIG. 2 is a partially schematic cross-sectional view of a further photoresponsive imaging member of the present invention.

Illustrated in FIG. 2 is a photoresponsive imaging member of the present invention comprised of a supporting substrate 15, a barrier layer 17 of hydrogenated amorphous silicon nitride with about 1,000 parts per million of boron, a photoconducting layer of hydrogenated amorphous silicon 19 with about 3 parts per million of boron, and of a thickness of from about 5 microns to about 60 microns, and a top overcoating layer 21 of a thickness of 0.1 to about 0.5 micron of silicon nitride with excess silicon, that is 1 part of silicon and 0.45 parts of nitrogen.

The inclusion of other elements such as germanium or tin in the hydrogenated amorphous silicon photoconducting layer can easily be accomplished by the simultaneous glow discharge of, for example, silane and germane or stanane. The alloying of silicon with germanium and/or tin is useful because the band gap of the alloy is smaller than that of the hydrogenated amorphous silicon itself, and thus a photoresponse to longer wavelengths is obtained.

The supporting substrates for each of the imaging members illustrated in the Figures may be opaque or substantially transparent, and may comprise various suitable materials having the requisite mechanical properties. Thus, the substrate can be comprised of numerous substances providing the objectives of the present invention are achieved. Specific examples of substrates include insulating materials such as inorganic or organic polymeric materials, a layer of an organic or inorganic material having a semiconductive surface layer thereon, such as indium tin oxide, or a conductive material such as, for example, aluminum, chromium, nickel, brass, stainless steel, or the like. The substrate may be flexible or rigid and may have many different configurations such as, for example, a plate, a cylindrical drum, a scroll, an endless flexible belt, and the like. Preferably, the substrate is in the form of a cylindrical drum, or endless flexible belt. In some situations, it may be desirable to coat on the back of the substrate, particularly when the substrate is an organic polymeric material, an anticurl layer such as, for example, polycarbonate materials commercially available as Makrolon. The substrates are preferably comprised of aluminum, stainless steel sleeve, or an oxidized nickel composition.

The thickness of the substrate layer depends on many factors including economical considerations and mechanical properties. Accordingly, thus this layer can be of a thickness of from about 0.01 inch to about 0.2 inch, and preferably is of a thickness of from about 0.05 inch to about 0.15 inch. In one particularly preferred embodiment the supporting substrate is comprised of oxidized nickel in a thickness of from about 1 mil to about 10 mils.

The barrier layers are generally comprised of hydrogenated amorphous silicon nitride with p or n dopants selected from Groups III and II of the Periodic Table, inclusive of boron, phosphorous, arsenic, antimony, aluminum, and the like. These dopants are present in an amount that will prevent the minority carrier injection from the substrate. Generally, thus from about 100 parts per million to about 2,000 parts per million of dopant is present in the barrier layer. Also, the barrier layer is of a thickness of from about 0.05 micron to about 1 micron. The function of this layer is to improve the charge acceptance and reduce dark decay by preventing injection substrate or trapping of the minority carrier in the barrier layer.

With further respect to the silicon nitride barrier layers, there are selected those nitrides with silicon present in an amount of from about 30 percent to about 70 percent, and preferably from about 43 percent to about 70 percent. It is in this manner that the injection of charges are substantially eliminated from the substrate, and that adhesion is improved, both functions accomplished by one layer as contrasted, for example, to three layers of the prior art members.

Illustrative examples of materials selected for the photoconducting layer are hydrogenated, preferably with 10 to 40 percent of hydrogen, amorphous silicon especially amorphous silicon as described in the copending applications referred to hereinbefore. Also, particularly useful as photoconducting materials is amorphous silicon compensated with boron and phosphorus, reference U.S. Pat. No. 4,634,647 the disclosure of which has been incorporated herein by reference. More specifically, as indicated herein there is disclosed in this copending application an amorphous silicon composition with from about 25 parts per million by weight to about one weight percent of boron compensated with from about 25 parts per million by weight to about one weight percent of phosphorus. Preferably, the photoconducting bulk layer is comprised of hydrogenated amorphous silicon doped with from about 1 part per million to about 20 parts per million of boron. Other dopants include phosphorus, nitrogen, arsenic, aluminum, gallium, and indium.

A further important layer with respect to the imaging members of the present invention is the top overcoating layer, which in a preferred embodiment is comprised of nonstoichiometric silicon nitride. These overcoatings contain an excess of silicon thus enabling several objectives of the present invention to be achieved. More specifically, there is percent from about 95 percent to about 66.6 percent of silicon to about 33.4 atomic percent of nitrogen. It is in this manner that increases in the resolution of the generated images is obtained in view of the elimination of the lateral movement of charges at the interface between the photoconducting layer and the overcoating layer.

Other similar nonstoichiometric overcoatings may be selected for the imaging members of the present invention inclusive of silicon carbide, silicon fluoride, silicon oxide and the like. These coatings are generally of a thickness of from 0.05 to 2 microns, and preferably from 0.1 to 0.5 micron.

The imaging members of the present invention can be prepared in accordance with the processes as described in the copending applications referred to hereinbefore. More specifically, thus the barrier layers of the imaging members of the present invention can be prepared by simultaneously introducing into a reaction chamber a silane gas often in combination with diborane and ammonia for the purpose of doping or alloying. The bulk photoconducting layer is prepared by simultaneously introducing silane and diborane, and the overcoat layer is prepared by simultaneously introducing into the reaction chamber silane and ammonia. In one specific embodiment, the process of preparation involves providing a receptacle containing there in a first substrate electrode means, and a second counterelectrode means providing a cylindrical surface on the first electrode means, heating the cylindrical surface with heating elements contained in the first electrode means, while causing the first electrode means to axially rotate introducing into the reaction chamber a source of silicon containing gas often in combination with other diluting, doping, or alloying gases at a right angle with respect to the cylindrical member, applying an rf voltage between the first electrode means, supplying a current to the second electrode means whereby decomposition results in the deposition of a barrier layer of doped hydrogenated amorphous silicon nitride and a photoconducting layer of doped hydrogenated amorphous silicon on the cylindrical. Thereafter, there is introduced into the reaction chamber a mixture of silane gas and ammonia in a ratio (silane gas÷ammonia gas) of 0.75 silane to ammonia resulting in the formation of an overcoating layer of nonstoichiometric silicon nitride with excess silicon. The gas mixture pressure is maintained constant at between 500 and 1,000 milliTorr, and the radio frequency electrical power density is between 0.01 and 1 watts/cm$^2$ of electrode area. The substrate temperature during the deposition process can be between 150° C. and 300° C.

The amorphous silicon photoconducting layer is deposited by the glow discharge decomposition of a silane gas alone, or in the presence of small amounts of dopant gases such as diborane and/or phosphine. The range of useful flow rates, radio frequency power levels and reactor pressures are approximately the same as that described in the copending applications referred to herein. Specifically, the rates are 200 sccm of silane doped with 1.5 ppm of diborane at a reactor pressure of 850 mTorr, and a radio frequency power density of 0.13 watts/cm$^2$.

Specifically, also the barrier layer can be generated by simultaneously passing 86 sccm of silane containing 1 percent diborane and 114 sccm of ammonia into the reaction chamber, and wherein the reactor pressure is set at 550 millimeters and the radio frequency power is 0.07 watts/cm$^2$.

Passivating and protecting top overlayers can be fabricated using a variety of materials. Very useful are silicon nitride layers plasma deposited from, for example, silane and ammonia mixtures. The electrical conductivity of the passivation layer should not exceed about $10^{12}$ ohm-cm, and can be controlled by the proper choice of gas mixture ratios. Other materials of choice are silicon carbide, plasma deposited from silane and hydrocarbon gas, silicon oxide plasma deposited from silane, and a gaseous nitrogen oxygen compound.

With respect to the examples that follow, the boron doped hydrogenated amorphous silicon and overcoating layers of silicon nitride were fabricated in a stainless steel reactor with the gas composition, pressure, rf power, time of deposition and other parameters as detailed. Also, there were selected as the supporting substrates aluminum drums with an outer diameter of 84 millimeters, and a length of 335 millimeters. These drums were mounted in a stainless steel vacuum reactor, followed by rotating and heating to a temperature of 210° C. Thereafter, the reactor was evacuated by applying a vacuum thereto and the appropriate gases were introduced into the stainless steel reaction chamber with flow meters and flow valves. Throttle valves were selected to adjust the pressure, and further the fabrication was accomplished by rf (13.6 megacycles) plasma decomposition of the gases illustrated. A capacitively coupled configuration was selected by grounding the drum and utilizing a large concentric static electrode as the rf electrode. Subsequent to fabrication of the appropriate layers, argon was passed through the reactor while the drum was being simultaneously cooled.

The amorphous silicon photoreceptor members prepared were then tested in a standard scanner for the purpose of determining the photoconductive characteristics of each member. The scanner is an apparatus in which there is provision for mounting and rotating the drum along its axis. Charging corotron exposure and erase lamps and voltage measuring probes were mounted along the circumference. This testing was affected by permitting the scanner to operate at a surface speed of 20 revolutions per minute and subjecting the photoreceptor to a positive polarity of 7,000 volts corona potential with a 10 centimeter long corotron. Thereafter, the dark decay and the light induced decay of the potentials were measured by a series of electrical probes mounted along the circumference of the photoreceptor. The scanner results provided the charging capabilities of the photoreceptor structure, that is dark decay values; and the discharge characteristics of the photoreceptor when subjected to light illumination. Additionally, each of the prepared photoreceptor members proposed in the Examples were print tested in a Xerox Corporation 2830$^R$ copying apparatus.

The invention will now be described in detail with reference to specific preferred embodiments thereof, it being understood that these examples are intended to be illustrative only. The invention is not intended to be limited to the materials, conditions, or process parameters recited herein, it being noted that all parts and percentages are by weight unless otherwise indicated.

EXAMPLE I

A three layered amorphous silicon photoreceptor was fabricated on an aluminum drum of a diameter of 84 millimeters and a length of 355 millimeters as illustrated in U.S. Pat. No. 4,663,258, the disclosure of which is totally incorporated herein by reference, by introducing into a reaction chamber 200 sccm of silane gas doped with 100 parts per million of diborane. The throttle present on the reactor was adjusted to obtain a plasma pressure in the reaction vessel of 550 microns while the rf power was maintained at 50 watts. The first layer was deposited on the aluminum drum after 10 minutes resulting in a barrier layer of hydrogenated, 20 atomic percent of hydrogen, amorphous silicon doped with 100 parts per million boron and this layer was about 5,000 Å in thickness.

Subsequently, the bulk or second layer was applied to the barrier layer by introducing into the reaction chamber 200 sccm of silane gas and 3 sccm of silane gas doped with 100 parts per million of diborane. The plasma pressure in the chamber was maintained at 850 microns, the rf power was 100 watts, and the deposition time was 240 minutes. There resulted a bulk layer of a thickness of 24 microns consisting of hydrogenated, 40 atomic percent of hydrogen, amorphous silicon doped with 1.5 parts per million boron.

Thereafter, there was applied to the bulk layer an overcoating of nonstoichiometric silicon nitride containing excess silicon by introducing into the reaction chamber 86 sccm of silane gas and 114 sccm of ammonia. The plasma pressure in the reaction chamber was maintained at 550 microns, the rf power was set at 50 watts, and the deposition was completed in 10 minutes. There resulted an overcoating layer of silicon nitride containing a nitrogen to silicon atomic ratio (nitrogen÷silicon) of 0.45.

The electrical characteristics of the photoresponsive imaging member prepared was then measured in the aforementioned scanner indicating thereon a positive charge acceptance of 800 volts when the measuring probe was located so that the time of measurement was 0.13 seconds after charging. The scanner was operated in a constant current mode with a corona current of 15 microamps flowing through the photoreceptor. The dark decay rate following charging was 160 volts/-second, and the light energy required to discharge the photoreceptor was 20 ergs/cm$^2$. Also, the residual potential following exposure and erase was 10 volts. When this imaging member was print tested in a Xerox Corporation model 2830$^R$, there resulted prints of good 6 line pairs per millimeter (6 lp/mm) resolution. However, the adhesion of the component layers to the aluminum drum was marginal in that some of the barrier and photoconductor layer material chipped off the drum, which chipping increased as the drum was stored.

EXAMPLE II

A three layer photoresponsive imaging member was prepared by repeating the procedure of Example I with the exception that the first barrier layer was fabricated by flowing 86 sccm of silane gas and 114 sccm of ammonia. Further, the plasma pressure was maintained at 550 microns, the rf power selected was 50 watts, and the deposition time was 10 minutes. There resulted a barrier of undoped silicon nitride containing a nitrogen to silicon ratio (nitrogen÷silicon) of 0.45. The photoconductor bulk and the overcoat layers were fabricated as in Example I.

The electrical characteristics of the photoresponsive imaging member prepared was then measured in the scanner resulting in a positive charge acceptance of only 400 volts when the voltage measuring probe is located so that the time of measurement was 0.13 second after charging. The scanner is operated in a constant current mode with a corona current of 15 microamps flowing through the photoreceptor. The dark decay rate following charging was 340 volts/second, and the light energy required to discharge the photoreceptor was 20 ergs/cm$^2$. Also, the residual potential following exposure and erase was 30 volts. When this imaging member was print tested in a Xerox Corporation model 2830$^R$ copier, there resulted prints of acceptable 6 lp/mm resolution, however, these prints were of poor density because of the low charge acceptance. Adhesion of the component layers in this device to the drum resulted, however, and no chipping of the device was observed.

EXAMPLE III

A three layer photoresponsive imaging member was prepared by repeating the procedure of Example I with the exception that the barrier layer was fabricated by flowing 86 sccm of silane containing 1 percent diborane, and 114 sccm of ammonia. Further, the plasma pressure was maintained at 550 microns, the rf power selected was 50 watts, and the deposition time was 10 minutes. There resulted a barrier of boron doped silicon nitride containing a nitrogen to silicon ratio (nitrogen÷silicon) of 0.45. The photoconducting bulk and the overcoated layers were fabricated as in Example I.

The electrical characteristics of the photoresponsive imaging member prepared was then measured in the scanner resulting for the photoreceptor in a positive charge acceptance of 800 volts when the voltage measuring probe was located such that the time of measurement was 0.13 seconds after charging. The scanner was operated in a constant current from a corona current of 15 microamps flowing through the photoreceptor. The dark decay rate following charging was 103 volts/-second, and the light energy required to discharge the photoreceptor was 20 ergs/cm$^2$. Also, the residual potential following exposure and erase was 20 volts. When this imaging member was print tested in a Xerox Corporation model 2830$^R$ copier, there resulted prints of acceptable 6 lp/mm resolution, and high density because of the high charge acceptance of the device. Adhesion of the layers to the aluminum drum was superior, in that no chipping of the component layers of this device was observed.

EXAMPLE IV

A three layer photoresponsive imaging member was prepared by repeating the procedure of Example I with the exception that the barrier layer was fabricated by flowing 50 sccm of silane, and 150 sccm of ammonia. Further, the plasma pressure was maintained at 550 microns, the rf power selected was 50 watts, and the deposition time was 10 minutes. There resulted a barrier of undoped silicon nitride containing a nitrogen to silicon ratio (nitrogen÷silicon) of 0.75. The photoconducting bulk and the overcoated layers were fabricated as in Example I.

The photoresponsive imaging member prepared was then measured in a scanner resulting for the photoreceptor in a positive charge acceptance of 760 volts when the voltage measuring probe is located such that the time of measurement is 0.13 seconds after charging. The scanner is operated in a constant current from a corona current of 15 microamps flowing through the photoreceptor. The dark decay rate following charging was 132 volts/second, and the light energy required to discharge the photoreceptor was 20 ergs/cm$^2$. Also, the residual potential following exposure and erase was 45 volts. When this imaging member was print tested in a Xerox Corporation model 2830$^R$ copier, there resulted prints of acceptable 6 lp/mm resolution, and high density because of the high charge acceptance of the device. Adhesion of the layers to the aluminum drum was superior in that no chipping of the device was observed.

EXAMPLE V

A three layer photoresponsive imaging member was prepared by repeating the procedure of Example I with the exception that the barrier layer was fabricated by flowing 50 sccm of silane containing 1 percent diborane, and 150 sccm of ammonia. Further, the plasma pressure was maintained at 550 microns, the rf power selected was 50 watts, and the deposition time was 10 minutes. There resulted a barrier of boron doped silicon nitride containing a nitrogen to silicon ratio (nitrogen÷silicon) of 0.75. The photoconducting bulk and the overcoated layers were fabricated as in Example I.

The electrical characteristics of the photoresponsive imaging member prepared was then measured in the scanner, and there was present thereon a positive charge acceptance of 760 volts when the voltage measuring probe is located such that the time of measurement is 0.13 seconds after charging. The scanner is operated in a constant current from a corona current of 15 microamps flowing through the photoreceptor. The dark decay rate following charging was 147 volts/-second, and the light energy required to discharge the photoreceptor was 20 ergs/cm$^2$. Also, the residual potential following exposure and erase was 25 volts. When this imaging member was print tested in a Xerox Corporation model 2830$^R$ copier, there resulted prints of acceptable 6 lp/mm resolution, and high density because of the high charge acceptance of the device. Adhesion of this device to the aluminum drum was superior in that no chipping of the device was observed.

EXAMPLE VI

A three layer photoresponsive imaging member was prepared by repeating the procedure of Example I with the exception that the barrier layer was fabricated by flowing 200 sccm of silane containing 1 percent diborane. Further, the plasma pressure was maintained at 550 microns, the rf power selected was 50 watts, and the deposition time was 10 minutes. There resulted a barrier of boron, 1 atomic percent, doped silicon. The photoconducting bulk and the overcoated layers were fabricated as in Example I.

The electrical characteristics of the photoresponsive imaging member prepared was then measured in the scanner and there was present thereon a positive charge acceptance of 730 volts when the voltage measuring probe was located such that the time of measurement is 0.13 seconds after charging. The scanner was operated in a constant current from a corona current of 15 microamps flowing through the photoreceptor. The dark decay rate following charging was 176 volts/second, and the light energy required to discharge the photoreceptor was 20 ergs/cm$^2$. Also, the residual potential following exposure and erase was 15 volts. When this imaging member was print tested in a Xerox Corporation model 2830$^R$ copier, there resulted prints of acceptable 6 lp/mm resolution, and high density because of the high charge acceptance of the device. Adhesion of the layer to the aluminum drum was marginal in that chipping of the device was observed.

Although the invention has been described with reference to specific preferred embodiments, it is not intended to be limited thereto. Rather, those of skill in the art will recognize that variations and modifications, including equivalents thereof, may be made therein which are included within the spirit of the present invention, and within the scope of the following claims.

What is claimed is:

1. An imaging member comprised of a supporting substrate, a barrier layer of hydrogenated amorphous silicon nitride with dopants, a photoconducting layer which comprises a material selected from the group consisting of a hydrogenated amorphous silicon-tin alloy, and a hydrogenated amorphous carbon-germanium alloy, and in contact therewith a top overcoating layer of nonstoichiometric silicon nitride.

2. An imaging member in accordance with claim 1 wherein the barrier layer is doped with boron or phosphorus.

3. An imaging member in accordance with claim 2 wherein the dopants are present in an amount of from about 100 parts per million to about 2,000 parts per million.

4. An imaging member in accordance with claim 1 wherein the barrier layer contains from about 30 percent to about 70 percent of silicon doped with boron or phosphorus.

5. An imaging member in accordance with claim 1 wherein the photoconducting layer is doped with boron or phosphorus.

6. An imaging member in accordance with claim 5 wherein the dopants are present in an amount of from about 1 part per million to about 20 parts per million.

7. An imaging member in accordance with claim 1 wherein the photoconducting layer is doped with phosphorus or boron separately or simultaneously in an amount of from about 2 parts per million to about 100 parts per million.

8. An imaging member which comprises a supporting substrate, a barrier layer of hydrogenated amorphous silicon nitride with dopants, a photoconducting layer comprising a hydrogenated amorphous silicon-tin alloy, and in contact with the photoconducting layer a top overcoating layer of nonstoichiometric silicon nitride.

9. An imaging member which comprises a supporting substrate, a barrier layer of hydrogenated amorphous silicon nitride with dopants, a photoconducting layer comprising a hydrogenated amorphous carbon-germanium alloy, and in contact with the photoconducting layer a top overcoating layer of nonstoichiometric silicon nitride.

10. An imaging member in accordance with claim 1 wherein the overcoating layer is comprised of silicon nitride wherein the atomic ratio of nitrogen to silicon is from 0.1 to about 0.5.

11. An imaging member in accordance with claim 1 wherein the substrate is comprised of aluminum.

12. An imaging member in accordance with claim 1 wherein the substrate is a flexible belt.

13. An imaging member in accordance with claim 1 wherein the thickness of the photoconducting layer is from about 1 micron to about 60 microns.

14. An imaging member in accordance with claim 1 wherein the thickness of the overcoating layer is from about 0.02 micron to about 2 microns.

15. A method of imaging which comprises providing the photoresponsive imaging member of claim 1 subjecting this member to imagewise exposure, developing the resulting image with a toner composition, and subsequently transferring the image to a suitable substrate.

16. A method of imaging in accordance with claim 15 wherein the photoconducting layer is doped with phosphorus or boron separately or simultaneously in an amount of from about 2 parts per million to about 110 parts per million.

17. A method of imaging which comprises providing a photoresponsive imaging member, subjecting this member to imagewise exposure, developing the resulting image with a toner composition, and subsequently transferring the image to a suitable substrate, wherein the photoresponsive imaging member comprises a supporting substrate, a barrier layer of hydrogenated amorphous silicon nitride with dopants, a photoconducting layer which comprises a hydrogenated amorphous silicon-tin alloy and in contact with the photoconducting layer a top overcoating layer of nonstoichiometric silicon nitride.

18. A method of imaging which comprises providing a photoresponsive imaging member, subjecting this member to imagewise exposure, developing the resulting image with a toner composition, and subsequently transferring the image to a suitable substrate, wherein the photoresponsive imaging member comprises a supporting substrate, a barrier layer of hydrogenated amorphous silicon nitride with dopants, a photoconducting layer which comprises hydrogenated amorphous carbon-germanium alloy; and in contact with the photoconducting layer a top overcoating layer of nonstoichiometric silicon nitride.

19. A method of imaging in accordance with claim 15 wherein the barrier layer contains silicon in an amount of from about 30 percent to about 70 percent.

20. A method of imaging in accordance with claim 15 wherein the thickness of the photoconducting layer is from about 1 micron to about 60 microns.

21. A method of imaging in accordance with claim 15 wherein the thickness of the overcoating layer is from about 0.02 micron to about 2 microns.

22. A method of imaging in accordance with claim 15 wherein the barrier layer is doped with boron or phosphorus.

23. A method of imaging in accordance with claim 22 wherein dopants are present in an amount of from about 100 parts per million to about 200 parts per million.

24. A method of imaging in accordance with claim 15 wherein the overcoating layer is comprised of silicon nitride wherein the atomic ratio of nitrogen to silicon is from about 0.1 to about 0.5.

25. A method of imaging in accordance with claim 15 wherein the substrate is comprised of aluminum.

26. A method of imaging in accordance with claim 15 wherein the substrate is a flexible belt.

27. A method of imaging in accordance with claim 15 wherein lateral movement of charges is eliminated at the interface of the overcoating layer and the photoconducting layer, and the barrier layer prevents injection of carriers from the substrate enabling images with high resolution to be obtained.

28. A method of imaging in accordance with claim 15 wherein the barrier layer increases the adhesion to the substrate thereby enabling mechanical integrity.

* * * * *